US011840840B1

(12) United States Patent
Meeks

(10) Patent No.: US 11,840,840 B1
(45) Date of Patent: Dec. 12, 2023

(54) COLLAPSIBLE ROOF CHANNELS

(71) Applicants: Robert B Jordan, IV, Mt. Gilead, NC (US); Eddie Alexander Meeks, Greensboro, NC (US)

(72) Inventor: Eddie Alexander Meeks, Greensboro, NC (US)

(73) Assignees: Robert B. Jordan, IV, Mt. Gilead, NC (US); Eddie Alexander Meeks, Greensboro, NC (US)

( * ) Notice: Subject to any disclaimer, the term of this patent is extended or adjusted under 35 U.S.C. 154(b) by 0 days.

(21) Appl. No.: 17/726,699

(22) Filed: Apr. 22, 2022

Related U.S. Application Data

(60) Provisional application No. 63/179,192, filed on Apr. 24, 2021.

(51) Int. Cl.
*E04D 13/17* (2006.01)

(52) U.S. Cl.
CPC ..... *E04D 13/178* (2013.01); *E04D 13/172* (2013.01)

(58) Field of Classification Search
CPC ..... E04D 13/178; E04D 13/172
See application file for complete search history.

(56) References Cited

U.S. PATENT DOCUMENTS

| | | | | |
|---|---|---|---|---|
| 4,189,878 | A | 2/1980 | Fitzgerald | |
| 4,214,510 | A | 7/1980 | Ward | |
| 4,776,262 | A | 10/1988 | Curran | |
| 5,094,054 | A * | 3/1992 | Arends | E04D 13/178 52/302.1 |
| 6,346,040 | B1 | 2/2002 | Best | |
| 6,754,995 | B1 * | 6/2004 | Davis | E04D 13/158 52/95 |
| 8,733,064 | B2 * | 5/2014 | Madison | E04D 13/152 52/95 |
| 8,782,982 | B2 * | 7/2014 | Lewis | E04B 1/7654 52/404.3 |
| 8,973,310 | B1 | 3/2015 | Henderson | |
| 10,400,444 | B1 | 9/2019 | Graboski et al. | |
| 2004/0134137 | A1 | 7/2004 | Geer et al. | |
| 2005/0072072 | A1 | 4/2005 | Duncan et al. | |
| 2008/0280554 | A1 | 11/2008 | Kortuem et al. | |
| 2010/0005755 | A1 | 1/2010 | Snyder et al. | |
| 2010/0146892 | A1 | 6/2010 | Rider, Jr. et al. | |
| 2010/0227540 | A1 | 9/2010 | Smith | |
| 2011/0030287 | A1 | 2/2011 | Moore | |
| 2013/0205708 | A1 | 8/2013 | Shaw | |

FOREIGN PATENT DOCUMENTS

WO WO-2015033174 A1 * 3/2015 ..... E04D 13/152

* cited by examiner

*Primary Examiner* — Adriana Figueroa

(74) *Attorney, Agent, or Firm* — MacCord Mason PLLC

(57) ABSTRACT

A collapsible air gap device and assembly. In one embodiment, the device comprises an upper plate, a lower plate, and a rib secured at the upper plate and at the lower plate. The result is a hybrid ventilation device adapted to ventilate an attic space in a variety of configurations.

19 Claims, 10 Drawing Sheets

COLLAPSIBLE ROOF CHANNELS

BACKGROUND

This application claims the benefit of U.S. provisional application No. 63/179,192, filed Apr. 24, 2021, which is incorporated herein by reference in its entirety.

FIELD

The present disclosure relates generally to roof ventilation and, more particularly, to a universal collapsible air gap system and assembly.

Roofing assemblies often support air circulation both within an attic space, and from the attic space to an exterior to facilitate heat exchange, and the like. For instance, it may be advantageous to maintain air movement from within the attic space to facilitate convection cooling in the warmer months and/or minimize winter weather damage in the cooler months. Attic surfaces often include insulation to support these principles; however, insulation often blocks, or impedes, proper air flow from an interior attic space to a building exterior. Therefore, Applicant desires a system and method for improved, reliable air gap performance without the drawbacks presented by the traditional systems and methods.

BRIEF DESCRIPTION OF THE DRAWINGS

Embodiments of the disclosure will be better understood by a reading of the Description of Embodiments along with a review of the drawings, in which.

SUMMARY

Figure 1:
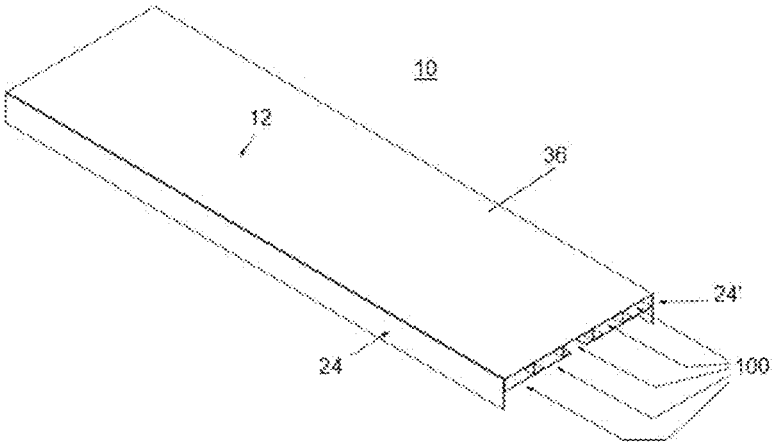
FIG. 1 is a top perspective view of an air gap in an opened position according to one embodiment of the disclosure, with elements removed for clarity.

Applicant desires an air gap device, system, assembly, and method of use without the drawbacks presented by the traditional systems and methods. Those skilled in the art having the benefit of this disclosure will recognize additional features, advantages over conventional systems, and improvements for roof ventilation and the like.

In accordance with the present inventions, Applicant's universal device and assembly provides an air gap channel along a surface, including, but not limited to, a roof surface. These inventions provide an improved hybrid device and system that is convenient, efficient, and safe for the user, particularly when handling in a collapsed storage position to expanding into an assembled, substantially-rigid operating position.

In one embodiment, a collapsible air gap device comprises a longitudinally extending upper plate having at least one first moving pivot; and a longitudinally extending lower plate having at least one second moving pivot opposing the first moving pivot, and wherein the upper plate and the lower plate hinge from one another to define an interior volume with segmented air pockets.

In certain examples, the device includes at least one rib extension extending between the upper plate and the lower plate. The at least one rib extension may include a reverse motion rib secured at the upper plate and at the lower plate. The upper plate and the lower plate may be hinged apart from one another defines a three-dimensional expanded configuration. The three-dimensional expanded configuration may be adapted for unencumbered movement of air within the segmented air pockets. The device may align along a roof surface and providing unencumbered movement of air into the air gap at a proximate opening, traversed along a length, and released through a distal opening. The proximate opening may align adjacent a lower roof portion. The proximate opening may align adjacent a soffit. The distal opening may align adjacent an upper roof portion. The distal opening may align adjacent an upper roof vent.

In certain examples, the three-dimensional expanded configuration defines an air gap barrier between an insulation and an attic roof surface. The device may be moveable from a collapsed position wherein the lower plate being substantially coplanar with the upper plate, and hinged to an expanded position wherein the lower plate being offset from the upper plate. The upper plate may be hinged about the lower plate in one direction. The upper plate and lower plate may hinge substantially ninety degrees from one another. The upper plate and lower plate may hinge no more than substantially ninety degrees from one another. The device may be in a flat collapsible configuration and a three-dimensional expanded configuration.

In one embodiment, a collapsible air gap device comprises a longitudinally extending upper plate having a pair of opposing hinged peripheral panels; a longitudinally extending lower plate having a pair of opposing hinged interior flaps affixed about the peripheral panels; and at least one reverse motion rib secured at the upper plate and at the lower plate and aligned between the peripheral panels.

In certain examples, the device includes a distal hinge between the upper plate and the peripheral panel, and a proximate hinge between the lower panel and the interior flap. The distal hinge may include an interior fold. The interior fold may include a die cut V-shape. The interior fold may include a pressed V-shape. The distal hinge may include an exterior notch. The exterior notch may include a die cut V-shape. The proximate hinge may include an interior fold. The interior fold may include a die cut V-shape. The interior fold may include a pressed V-shape.

In particular examples, the proximate hinge includes an exterior notch. The reverse motion rib may include a lower fixed tab aligned about the lower plate. The device may include a fastener securing the lower fixed tab about the lower plate. The fastener may include an adhesive. The reverse motion rib may include an upper fixed tab aligned about the upper plate. The device may include fastener securing the upper fixed tab about the upper plate. The fastener may include an adhesive.

In certain examples, the reverse motion rib includes a first moving pivot. The first moving pivot may include a first rib notch. The first rib notch may include a die cut V-shape. The first rib notch may include a pressed V-shape. The first moving pivot may include a first rib bend. The reverse motion rib may include a second moving pivot. The second moving pivot may include a second rib notch. The second rib notch may include a die cut V-shape. The second rib notch may include a pressed V-shape. The second moving pivot may include a second rib bend.

In particular examples, the device includes a plurality of spaced apart reverse motion ribs. The device may include a plurality of air gap cavities aligned about the reverse motion ribs defining a ventilation channel. The air gap cavities may include a substantially rigid rectangular cross section. The device may include a pair of exterior air gap cavities. The pair of exterior air gap cavities may include an interior flap surface, an inner surface of the upper panel, a rib extension surface, and an inside surface of the lower plate. The interior flap surface and the rib extension surface may oppose one another and the inner surface of the upper panel and inside surface of the lower plate may oppose one another, and the interior flap surface and the rib extension surface may be substantially perpendicular to the inner surface of the upper panel and inside surface of the lower plate.

In certain examples, the device may include a pair of interior air gap cavities. The pair of interior air gap cavities may include a first rib surface, an inner surface of the upper panel, a second rib surface, and an inside surface of the lower plate. The first rib surface and the second rib surface may oppose one another and the inner surface of the upper panel and inside surface of the lower plate may oppose one another, and the first and second rib surfaces may be substantially perpendicular to the inner surface of the upper panel and inside surface of the lower plate.

In particular examples, the peripheral panel is hinged to the upper plate about an interior fold. The peripheral panel may be hinged to the upper plate about an exterior notch. The exterior notch may include a die cut V-shape. The exterior notch may include a pressed V-shape. The interior flap may be hinged to the lower plate about an interior fold. The interior flap may be hinged to the lower plate about an exterior notch. The exterior notch may include a die cut V-shape. The exterior notch may include a pressed V-shape.

In certain examples, the lower plate includes at least one aperture to receive a fastener assembly. The aperture may include an elongated slot adapted to receive a staple gun. The first panel and second panel may be formed of a semi rigid material. The semi rigid material may have a flat collapsible configuration. The flat collapsible configuration may align in an indeterminate length-rolled stock. The semi rigid material may include at least one wax coated cardboard surface, a wax coated paper surface, a plastic material, a combination thereof, and the like.

In one embodiment, a ventilation channel comprises a longitudinally extending upper plate; a longitudinally extending lower plate; and at least one reverse motion rib secured between the upper plate and the lower plate, and wherein the reverse motion rib pivots between substantially parallel with the upper and lower plates in a collapsed position to substantially perpendicular with the upper and lower plates in an expanded operating position.

In certain examples, the device includes at least two air cap cavities spaced on opposing sides of the reverse motion rib. The air gap cavities may include a substantially rigid rectangular cross section. The device may include a plurality of reverse motion ribs. The device may include a plurality of interior air gap cavities having a first rib surface, an inner surface of the upper panel, a second rib surface, and an inside surface of the lower plate. The first rib surface and the second rib surface may oppose one another and the inner surface of the upper panel and inside surface of the lower plate may oppose one another, and the first and second rib surfaces may be substantially perpendicular to the inner surface of the upper panel and inside surface of the lower plate.

In particular examples, the device includes a pair of exterior air gap cavities. The pair of exterior air gap cavities may include an interior flap surface, an inner surface of the upper panel, a rib extension surface, and an inside surface of the lower plate. The interior flap surface and the rib extension surface may oppose one another and the inner surface of the upper panel and inside surface of the lower plate may oppose one another, and the interior flap surface and the rib extension surface may be substantially perpendicular to the inner surface of the upper panel and inside surface of the lower plate.

In certain examples, the upper plate may include a peripheral panel, and a distal hinge between the upper plate and the peripheral panel. The distal hinge may include an interior fold. The interior fold may include a die cut V-shape. The interior fold may include a pressed V-shape. The distal hinge may include an exterior notch. The exterior notch may include a die cut V-shape. The lower plate may include an interior flap, and a proximate hinge between the lower panel and the interior flap. The proximate hinge may include an interior fold. The interior fold may include a die cut V-shape. The interior fold may include a pressed V-shape. The proximate hinge may include an exterior notch. The reverse motion rib may include a lower fixed tab aligned about the lower plate. The device may include a fastener securing the lower fixed tab about the lower plate. The fastener may include an adhesive.

In particular examples, the reverse motion rib includes an upper fixed tab aligned about the upper plate. The device may include a fastener securing the upper fixed tab about the upper plate. The fastener may include an adhesive. The reverse motion rib may include a first moving pivot. The first moving pivot may include a first rib notch. The first rib notch may include a die cut V-shape. The first rib notch may include a pressed V-shape. The first moving pivot may include a first rib bend. The reverse motion rib may include a second moving pivot. The second moving pivot may include a second rib notch. The second rib notch may include a die cut V-shape. The second rib notch may include a pressed V-shape. The second moving pivot may include a second rib bend. The peripheral panel may be hinged to the upper plate about an interior fold. The peripheral panel may be hinged to the upper plate about an exterior notch. The exterior notch may include a die cut V-shape. The exterior notch may include a pressed V-shape.

In certain examples, the interior flap may be hinged to the lower plate about an interior fold. The interior flap may be hinged to the lower plate about an exterior notch. The exterior notch may include a die cut V-shape. The exterior notch may include a pressed V-shape. The lower plate may include at least one aperture adapted to receive a fastener assembly. The aperture may include an elongated slot adapted to receive a staple gun. The first panel and second panel may be formed of a semi rigid material. The semi rigid material may include a flat collapsible configuration. The flat collapsible configuration may align in an indeterminate length-rolled stock. The semi rigid material may include at least one wax coated cardboard surface. The semi rigid material may include at least one wax coated paper surface. The semi rigid material may include a plastic material.

In one embodiment, an assembly comprises a roof deck; an insulation; and an expandable air gap channel having a reverse motion rib spacing the insulation from the roof deck.

In certain examples, the roof deck comprises a rafter. The roof deck may include a substrate, for instance a plywood surface between opposing rafters.

In one embodiment, a method of ventilating an attic space having a roof comprises providing a length of an expandable air gap channel having a reverse motion rib; expanding the length of air gap channel; and affixing the length of expanded air gap channel substantially along the roof surface.

In particular examples, the method includes positioning a proximate end of the length of expanded air gap channel adjacent a soffit. The method may include positioning a distal end of the length of expanded air gap channel downstream of the soffit. The method may include positioning the distal end about a roof vent. The method may include providing a movement of air between a soffit and a roof vent. The method may include aligning insulation along an exterior of the expanded length of air gap channel. The method may include blocking insulation from filling in a space along a rafter.

The above summary was intended to summarize certain embodiments of the present disclosure. Embodiments will be set forth in more detail in the figures and description of embodiments below. It will be apparent, however, that the description of embodiments is not intended to limit the present inventions, the scope of which should be properly determined by the appended claims.

DETAILED DESCRIPTION

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Figure 2:
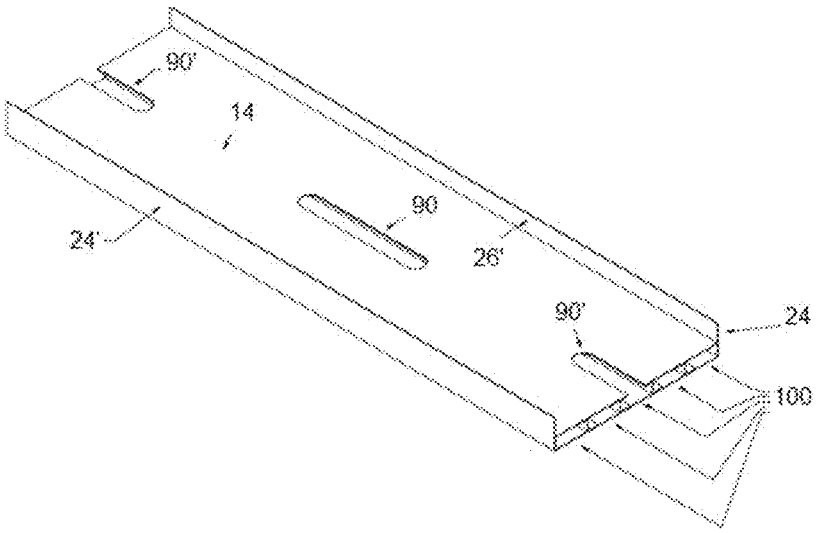
FIG. 2 is a bottom view of an air gap according to FIG. 1.
Figure 3:
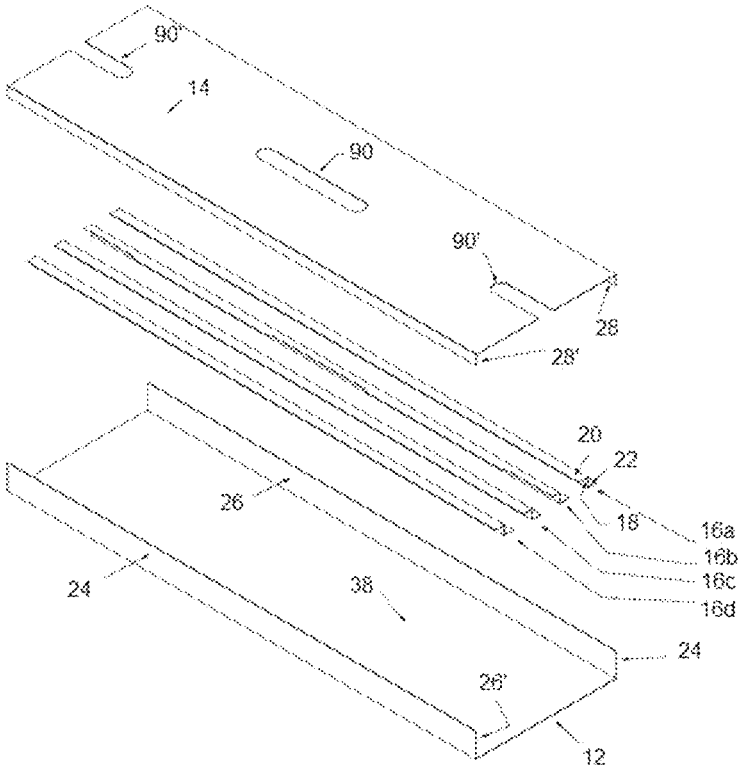
FIG. 3 is an exploded view of an air gap according to FIG. 1.
Figure 4:
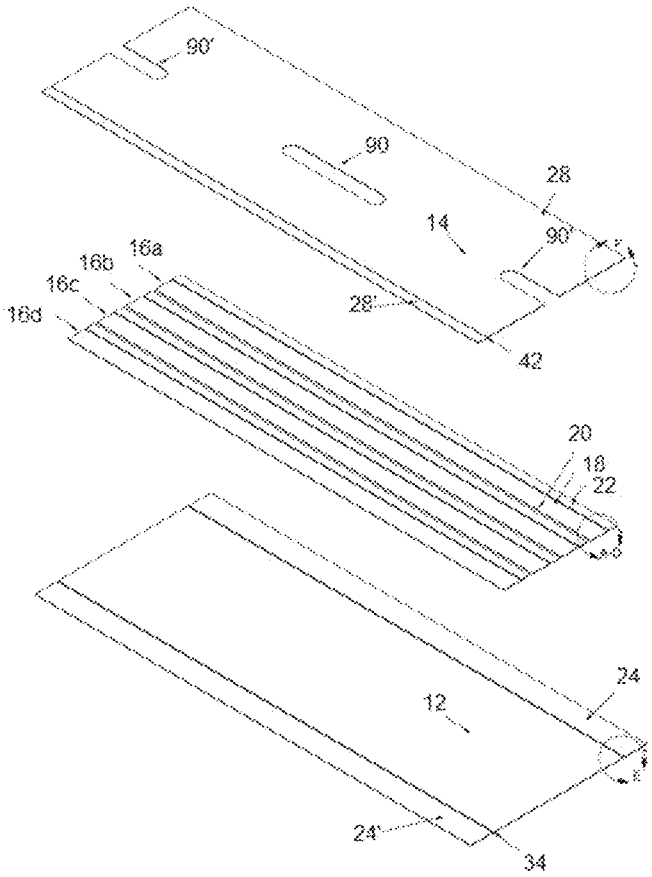
FIG. 4 is an exploded view of an air gap in an unassembled position according to one embodiment of the disclosure in an operating position.
Figure 4A:
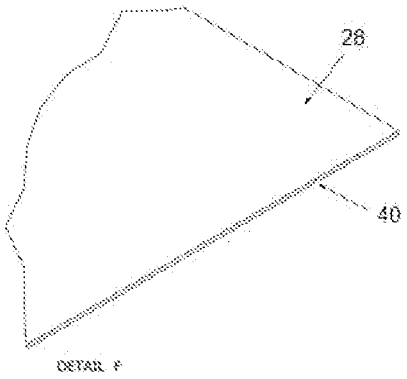
FIG. 4A is a top view of isolated air gap features according to FIG. 4.
Figure 4B:
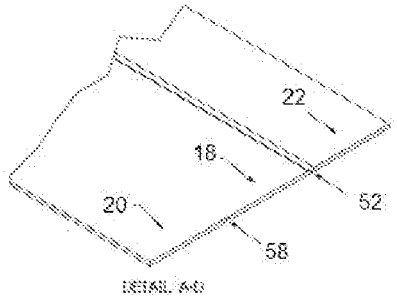
FIG. 4B is a top view of isolated air gap features according to FIG. 4.
Figure 4C:
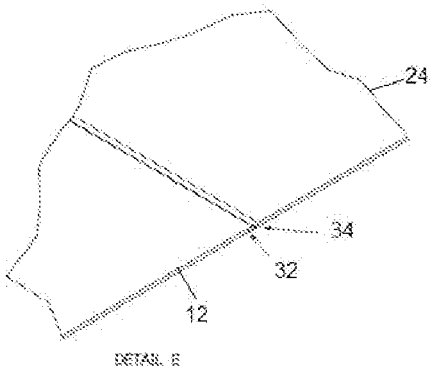
FIG. 4C is a top view of isolated air gap features according to FIG. 4.
Figure 5:
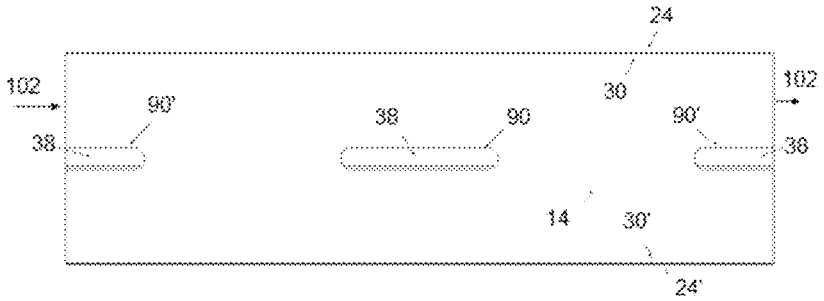
FIG. 5 is a bottom view of an air gap in an opened position according to one embodiment of the disclosure.
Figure 6:
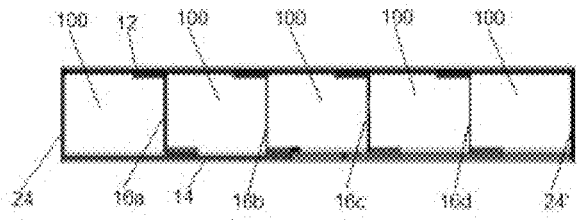
FIG. 6 is an end view of an air gap in an opened position according to one embodiment of the disclosure.
Figure 7:
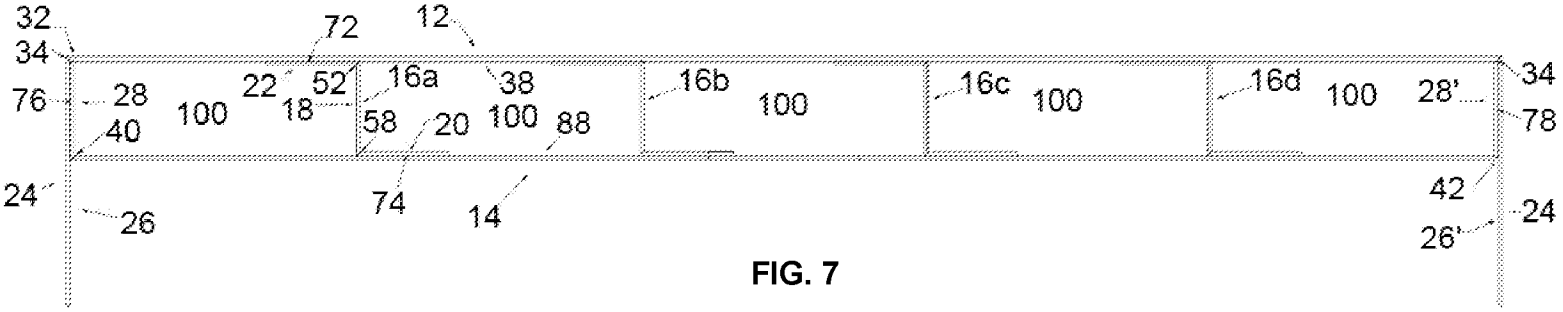
FIG. 7 is an end view of an air gap in an opened position according to one embodiment of the disclosure.
Figure 8:
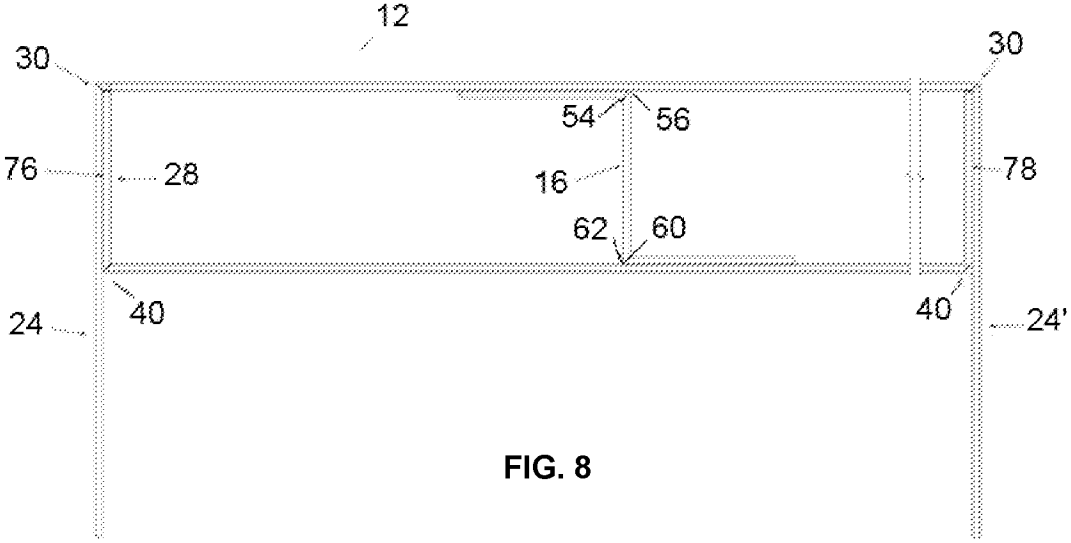
FIG. 8 is an end view of air gap features according to FIG. 7.
Figure 14:
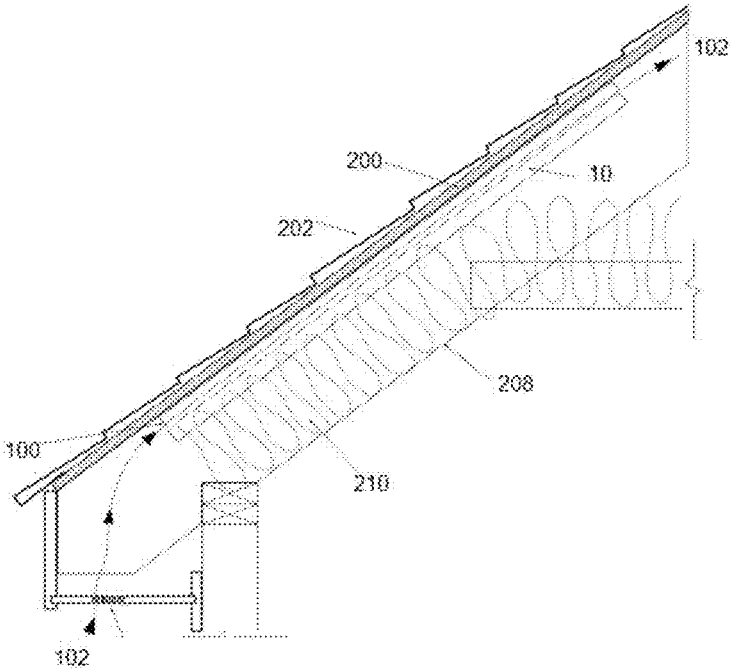
FIG. 14 is a side view of an assembled air gap according to one embodiment of the disclosure.

Referring now to the drawings in general and FIG. 1 in particular, it will be understood that the illustrations are for the purpose of describing embodiments of the disclosure and are not intended to limit the disclosure or any inventions thereto. As best seen in FIGS. 1-2 and 14, the expandable/collapsible air gap device 10 creates a ventilation space to channel air flow 102 along a roof surface, or the like. As shown, the device 10 creates and maintains an improved air gap when secured about a roof 202 substrate 200, for instance along adjacent side(s) of rafters 208. Further, Applicant has unexpectedly discovered the device's 10 unforeseen advantages of blocking insulation 210 from plugging the cavity, or the like, between rafters 208 to additionally improve and maintain ventilation, temperature control, etc. from an attic/roof space to an exterior. In addition, Applicant has discovered unexpected advantages of providing the device 10 in an indeterminate length, for instance on a stock roll in the collapsed position for ease of transporting product and matching/cutting on-site dimensions before expansion and alignment as shown and described herein. Those skilled in the art having the benefit of this disclosure will recognize additional sizes, including but not limited to predetermined length segments and width alternatives, orientations, materials, and arrangement of elements.

As shown in FIG. 1-4, a collapsible air gap device 10 may have a longitudinally extending upper plate 12 having a pair of opposing hinged peripheral panels 24, 24'; a longitudinally extending lower plate 14 having a pair of opposing hinged interior flaps 28,28' affixed about the peripheral panels 24, 24' in the assembled position; and at least one inner support rib, for instance a reverse motion rib 18, secured at the upper plate 12 and at the lower plate 14.

In certain examples, the device 10 includes a distal hinge 30 between the upper plate 12 and the peripheral panel 24,24', and a proximate hinge 40 between the lower panel 14 and the interior flap 28. The distal hinge 30 may include an interior fold 32. The interior fold 32 may include a pressed, die cut V-shape, or the like. The distal hinge 30 may include an exterior notch 34, for instance a pressed, die cut V-shape, or the like. Similarly, the exterior notch 34 may include a die cut V-shape or the like. The proximate hinge 40 may include an interior fold 42, exterior notch, and the like.

Figure 9:
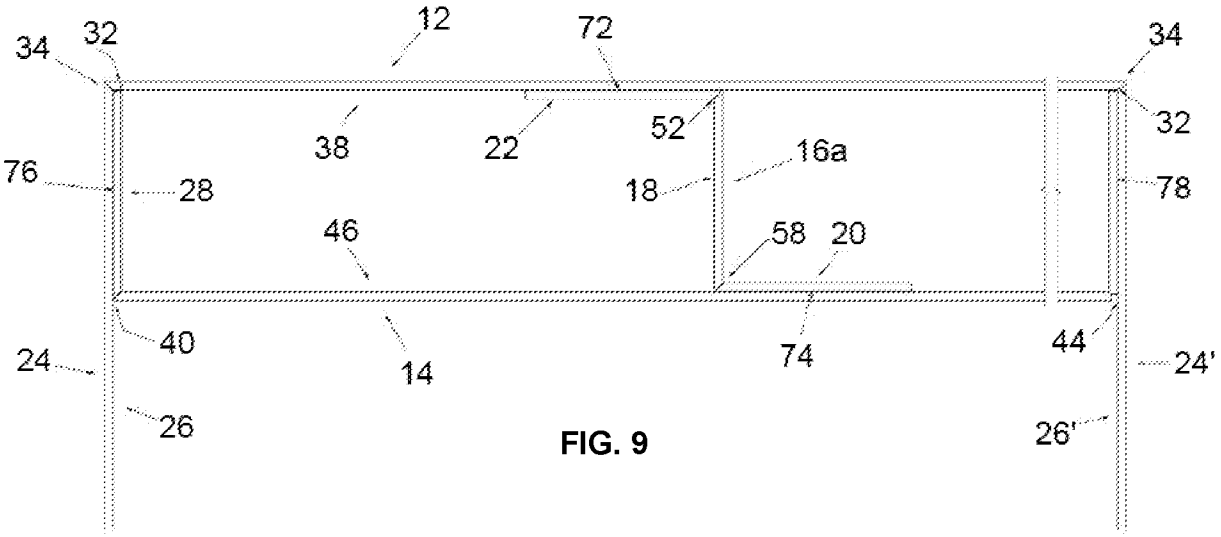
FIG. 9 is an end view of air gap features according to FIG. 7.
Figure 10:
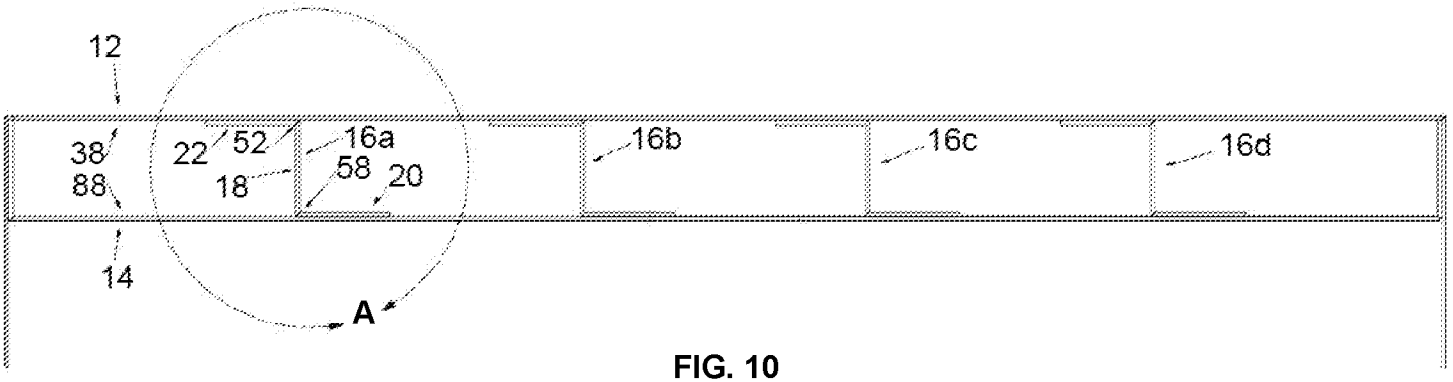
FIG. 10 is an end view of an air gap in an opened position according to one embodiment of the disclosure.
Figure 11:
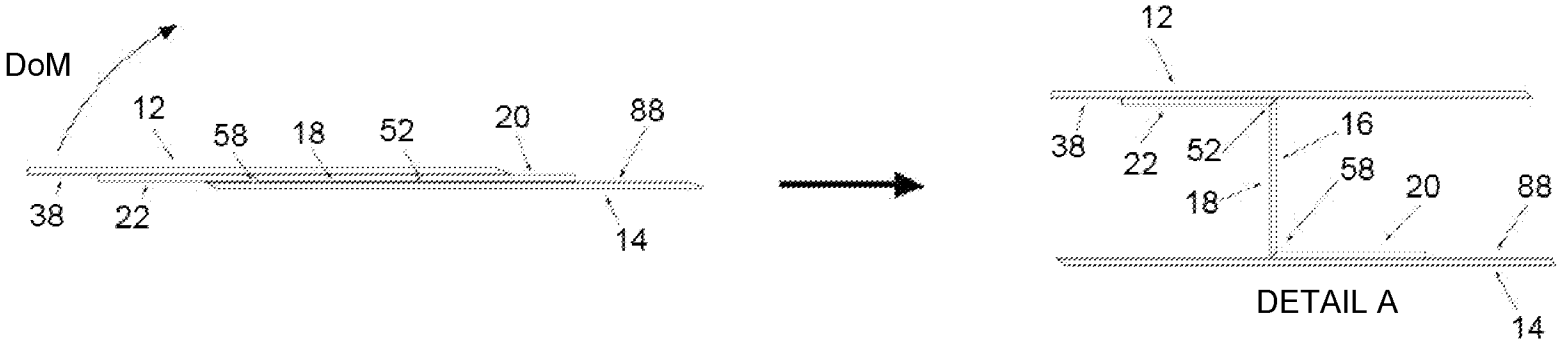
FIG. 11 is an end view of isolated air gap features in a flattened position to an opened state as shown in FIG. 10.
Figure 12:
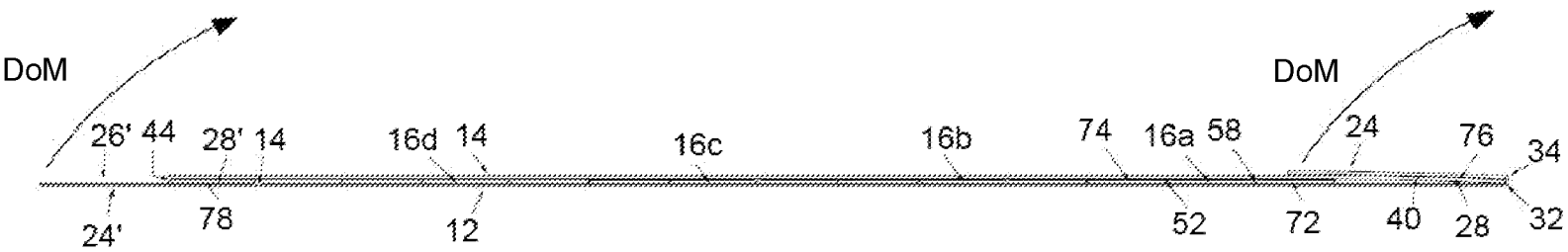
FIG. 12 is an end view of an air gap in a flattened, unassembled position according to one embodiment of the disclosure.
Figure 12A:
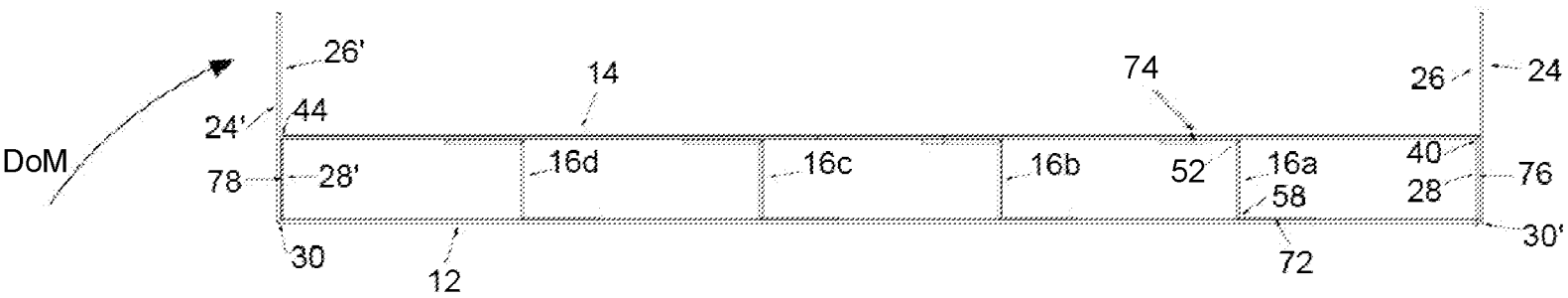
FIG. 12A is an end view of the air gap according to FIG. 12 in an open, assembled position according to one embodiment of the disclosure.
Figure 13:
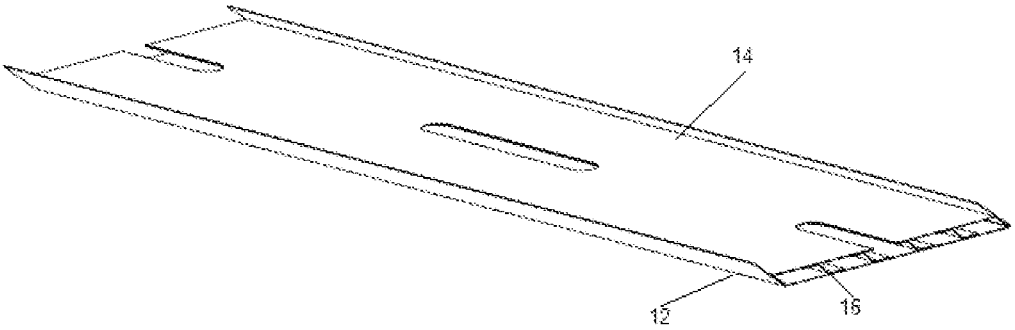
FIG. 13 is a bottom view of the air gap according to one embodiment of the disclosure in a partially expanded position.
Figure 13A:
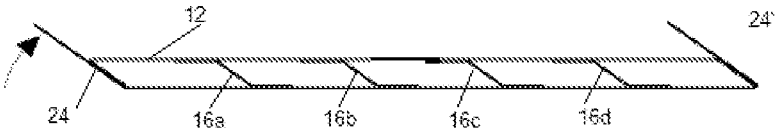
FIG. 13A is an end view of an air gap in a partially expanded position according to one embodiment of the disclosure.

Any of the ribs 18 herein may be affixed between opposing plate surfaces to provide the pivoting and/or hinging movements from a collapsed position to an operating, expanded position. For instance, reverse motion ribs 16*a*, 16*b*, 16*c*, 16*d*, may include a lower fixed tab 20 aligned about lower plate 14. As shown in FIG. 9, a fastener 74, for instance any adhesive, mechanical fastener, weld, or the like, may secure the lower fixed tab 20 about lower plate 14. Further, the rib 18 may include an upper fixed tab 22 aligned about upper plate 12. As shown in FIG. 9, a fastener 72, for instance any adhesive, mechanical fastener, weld, or the like, may secure the upper fixed tab 22 about upper plate 12.

As shown in FIGS. 3-4, 6-10, and 12-13*a*, reverse motion ribs 16*a*, 16*b*, 16*c*, 16*d* may include hinged, or pivoting, points, including, but not limited to, a first moving pivot 52 and second moving pivot 58. As illustrated, one embodiment of the first moving pivot 52 includes a first rib notch 56. The first rib notch 56 may include a pressed, die cut V-shape, or the like. The first moving pivot 52 may include a first rib bend 54. Similarly, the reverse motion ribs 16*a*, 16*b*, 16*c*, 16*d* may include a second moving pivot 58. The second moving pivot 58 may include a second rib notch 62. The second rib notch 62 may include a pressed, die cut V-shape, or the like. Further, the second moving pivot 58 may include a second rib bend 60.

In particular examples, the device includes a plurality of spaced apart reverse motion ribs 16*a*, 16*b*, 16*c*, 16*d* defining any of the air gap cavities 100 shown and described herein to define a ventilation channel. As shown, the air gap cavities may include a substantially rigid rectangular cross section. As illustrated, the device may include a pair of exterior air gap cavities. The pair of exterior air gap cavities may include an interior flap surface 28, an inner surface 38 of the upper panel 12, a rib extension surface 16, and an inside surface 88 of the lower plate 14. The interior flap surface 28 and the rib extension surface 16 may oppose one another and the inner surface 38 of the upper panel 12 and inside surface 38 of the lower plate 14 may oppose one another, and the interior flap surface 28 and the rib extension surface 16 may be substantially perpendicular to the inner surface 38 of the upper panel 12 and inside surface 88 of the lower plate 14.

As shown in FIGS. 1-4C, the peripheral panels 24, 24' may be hinged to the upper plate 12 about an interior fold 32, including any of the folds shown and described herein. The peripheral panel may be hinged to the upper plate about an exterior notch 34, including any of the notches shown and described herein. The interior flap 28 may be hinged to the lower plate 14 about an interior fold, including any of the folds shown and described herein. The interior flap 28 may be hinged to the lower plate 12 about an exterior notch, including any of the notches shown and described herein.

In certain examples, the lower plate includes at least one aperture 90, 90' to receive a fastener assembly, including a staple gun or the like to secure the device against any surface shown and described herein.

In one embodiment, a collapsible air gap device 10 includes a longitudinally extending upper plate 12 having a first moving pivot 52; and a longitudinally extending lower plate 14 having a second moving pivot 58 that is extended away, for instance opposing, or the like, from the first moving pivot 52. As shown and described herein, the upper plate 12 and the lower plate 14 thereby hinge from one another to define an interior volume with any number of segmented air pockets.

Figure 15:
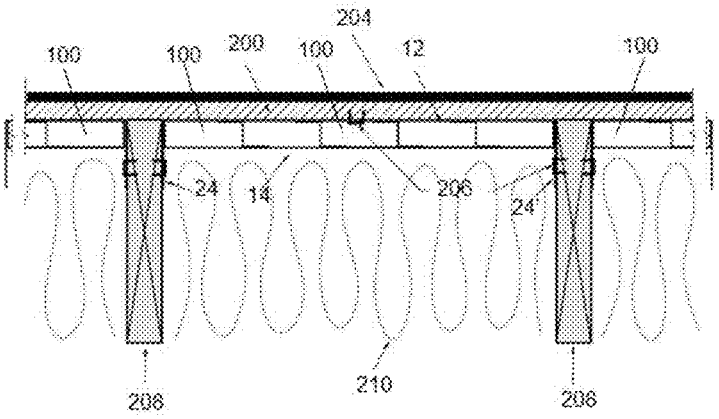
FIG. 15 is a cross view of the air gap assembly according to FIG. 14, with elements removed for clarity.

As shown in FIGS. 14 and 15, the three-dimensional expanded configuration of device 10 provides unencumbered movement of air 102 within the segmented air pockets. The device 10 may align along a roof surface 200 and providing unencumbered movement of air 102 into the air gap at a proximate opening, traversed along a length, and released through a distal opening. The proximate opening may align adjacent a lower roof portion, for instance a soffit, vent, or the like. The distal opening may align adjacent an upper roof portion. The distal opening may align adjacent an upper roof vent, opening, or the like.

As shown, the three-dimensional expanded configuration defines an air gap barrier between insulation 210 and an attic roof surface.

As shown and described herein, for instance in FIGS. 10-13A, device 10 may be moveable from a collapsed position (i.e. any storage, handling, and the like) to an expanded position (i.e. any operating, three dimensional, and the like). For instance, in the collapsed position the lower plate 14 may be substantially coplanar with the upper plate 12, and then through the direction of movement (DoM) hinged to an expanded position, wherein the lower plate 14 is offset from the upper plate 12. The upper plate 12 may be hinged about the lower plate 14 in one direction. The upper plate 12 and lower plate 14 may hinge substantially ninety degrees from one another. And in certain examples, the upper plate 12 and lower plate 14 may hinge no more than substantially ninety degrees from one another to provide any of the substantially rigid geometries and arrangements shown and described herein.

In one embodiment, a ventilation channel comprises a longitudinally extending upper plate 12; a longitudinally extending lower plate 14; and at least one reverse motion rib 16 secured between the upper plate 12 and the lower plate 14, and wherein the reverse motion rib 16 pivots between substantially parallel with the upper and lower plates 12, 14 in a collapsed position to substantially perpendicular with the upper and lower plates 12, 14 in an expanded operating position. Those skilled in the art having the benefit of this disclosure will recognize additional direction of movements, orientations, materials, and arrangement of elements.

In other embodiments, the disclosure includes a universal ventilation assembly kit. In such an embodiment, the kit may comprise a length of device 10, e.g. any of the air gap elements and components previously shown or described. Further, other embodiments of the kit may include insulation 210, e.g. any insulation elements and components previously shown or described.

Numerous characteristics and advantages have been set forth in the foregoing description, together with details of structure and function. Many of the novel features are pointed out in the appended example claims. The disclosure, however, is illustrative only, and changes may be made in detail, especially in matters of shape, size and arrangement of parts, within the principle of the disclosure, to the full extent indicated by the broad general meaning of the terms in which the general claims are expressed. It is further noted that, as used in this application, the singular forms "a," "an," and "the" include plural referents unless expressly and unequivocally limited to one referent.

What is claimed is:

1. A collapsible air gap device comprising:

a. a longitudinally extending upper plate having a pair of opposing hinged peripheral panels;

b. a longitudinally extending lower plate having a pair of opposing hinged interior flaps affixed about said peripheral panels; and c. at least one reverse motion rib secured at said upper plate and at said lower plate and aligned between said peripheral panels.

2. The device of claim 1, including a distal hinge between said upper plate and said peripheral panel, and a proximate hinge between said lower panel and said interior flaps.

3. The device of claim 2, wherein said distal hinge includes an interior fold and an exterior notch.

4. The device of claim 2, wherein said proximate hinge includes an interior fold and an exterior notch.

5. The device of claim 1, wherein said reverse motion rib includes a lower fixed tab aligned about said lower plate; an upper fixed tab aligned about said upper plate; and a first moving pivot.

6. The device of claim 5, wherein said reverse motion rib includes a second moving pivot.

7. The device of claim 6, wherein said second moving pivot includes a second rib notch and a second rib bend.

8. The device of claim 1, including a plurality of spaced apart reverse motion ribs and a plurality of air gap cavities aligned between said reverse motion ribs defining a ventilation channel.

9. The device of claim 1, including a pair of exterior air gap cavities.

10. The device of claim 9, wherein said pair of exterior air gap cavities comprise an interior flap surface, an inner surface of said upper panel, a rib extension surface, and an inside surface of said lower plate.

11. The device of claim 1, including a pair of interior air gap cavities.

12. The device of claim 11, wherein said pair of interior air gap cavities comprise a first rib surface, an inner surface of said upper panel, a second rib surface, and an inside surface of said lower plate.

13. The device of claim 1, wherein said peripheral panel hinged to said upper plate about an interior fold.

14. The device of claim 1, wherein said lower plate includes at least one aperture adapted to receive a fastener assembly.

15. The device of claim 1, wherein said first panel and said second panel are formed of a semi rigid material having a flat collapsible configuration.

16. A ventilation channel comprising:

a. a longitudinally extending upper plate having a pair of opposing hinged peripheral panels;

b. a longitudinally extending lower plate having a pair of opposing hinged interior flaps affixed about said peripheral panels; and c. at least one reverse motion rib secured between said upper plate and said lower plate, and wherein said reverse motion rib pivoting between substantially parallel with said upper and lower plates in a collapsed position to be substantially perpendicular with said upper and lower plates in an expanded operating position.

17. The device of claim 16, including at least two air gap cavities spaced on opposing sides of said reverse motion rib.

18. The device of claim 16, wherein a first rib surface and a second rib surface opposing one another and an inner surface of said upper panel and an inside surface of said lower plate opposing one another, and said first and second rib surfaces being substantially perpendicular to said inner surface of said upper panel and said inside surface of said lower plate.

19. The device of claim 16, wherein a pair of exterior air gap cavities comprise an interior flap surface, an inner surface of said upper panel, a rib extension surface, and an inside surface of said lower plate.

* * * * *